US008701364B2

(12) United States Patent
Wrightman

(10) Patent No.: US 8,701,364 B2
(45) Date of Patent: Apr. 22, 2014

(54) LOG WITH THERMAL BREAK

(75) Inventor: Ronald A. Wrightman, Canada (CA)

(73) Assignee: Ronald A. Wrightman, Bracebridge (CA)

( * ) Notice: Subject to any disclaimer, the term of this patent is extended or adjusted under 35 U.S.C. 154(b) by 0 days.

(21) Appl. No.: 13/471,276

(22) Filed: May 14, 2012

(65) Prior Publication Data

US 2012/0317907 A1 Dec. 20, 2012

Related U.S. Application Data

(60) Provisional application No. 61/485,852, filed on May 13, 2011.

(51) Int. Cl.

| | |
|---|---|
| ***E04B 1/10*** | (2006.01) |
| ***E04B 1/74*** | (2006.01) |
| ***E04B 2/70*** | (2006.01) |
| *E04B 1/76* | (2006.01) |

(52) U.S. Cl.
CPC .. *E04B 2/702* (2013.01); *E04B 1/76* (2013.01)
USPC ..... 52/233; 52/404.1

(58) Field of Classification Search
USPC ..... 52/233, 284, 286, 404.1, 406.1, 309.16, 52/309.1, 518–520, 536, 539, 542, 555
See application file for complete search history.

(56) References Cited

U.S. PATENT DOCUMENTS

| | | | | |
|---|---|---|---|---|
| 2,291,712 A | | 8/1942 | Hatton | |
| 3,189,950 A | | 6/1965 | Johnson | |
| 3,992,838 A | | 11/1976 | Vizziello | |
| 4,147,000 A | | 4/1979 | Lewandowski | |
| 4,269,013 A | | 5/1981 | West | |
| 4,344,263 A | * | 8/1982 | Farmont | 52/233 |
| 4,380,887 A | | 4/1983 | Lee | |
| 4,503,648 A | * | 3/1985 | Mahaffey | 52/223.7 |
| 4,937,122 A | | 6/1990 | Talbert | |
| 5,687,520 A | | 11/1997 | Stranahan et al. | |
| 5,881,515 A | * | 3/1999 | George | 52/233 |
| 6,212,844 B1 | | 4/2001 | Lange | |
| 6,385,929 B1 | * | 5/2002 | Englehart | 52/233 |
| 2004/0187411 A1 | * | 9/2004 | Clegg | 52/233 |
| 2005/0115177 A1 | | 6/2005 | Morgenstern | |
| 2005/0284051 A1 | | 12/2005 | Lehn | |
| 2006/0156656 A1 | * | 7/2006 | Robinson | 52/220.2 |
| 2006/0168904 A1 | * | 8/2006 | Muszynski | 52/233 |
| 2008/0184650 A1 | | 8/2008 | Fischer | |
| 2009/0133345 A1 | | 5/2009 | Wrightman | |
| 2010/0043323 A1 | | 2/2010 | Wrightman | |
| 2011/0146171 A1 | * | 6/2011 | Flatland | 52/233 |

FOREIGN PATENT DOCUMENTS

| | | |
|---|---|---|
| CA | 1146329 A | 5/1983 |
| CA | 1306094 C | 8/1991 |
| EP | 0314137 A1 | 5/1989 |

(Continued)

*Primary Examiner* — William Gilbert
*Assistant Examiner* — Kyle Walraed-Sullivan
(74) *Attorney, Agent, or Firm* — John R. S. Orange; Blake, Cassels & Graydon LLP

(57) ABSTRACT

A log for a log home has a plurality of pockets formed within the body of the log. The pockets are filled with foam to enhance the thermal rating of the log. A slot is provided between adjacent pockets to provide a thermal break.

19 Claims, 8 Drawing Sheets

(56) References Cited

FOREIGN PATENT DOCUMENTS

| | | | |
|---|---|---|---|
| FR | 2790021 | A1 | 8/2000 |
| GB | 2060044 | A | 4/1981 |
| NO | 173068 | B | 5/1992 |
| WO | WO 93/01037 | A1 | 1/1993 |
| WO | WO 95/30807 | A1 | 11/1995 |
| WO | WO 96/07802 | A1 | 3/1996 |
| WO | WO 98/23825 | A1 | 6/1998 |

* cited by examiner

LOG WITH THERMAL BREAK

CROSS REFERENCE

The present application claims priority from U.S. Provisional Application No. 61/485,852 filed May 13, 2011, incorporated herein by reference.

FIELD OF THE INVENTION

The present invention relates to logs for use in log homes.

It is well known to utilize logs stacked one above another to form the wall of a house. The intersection of logs at corners is accommodated through overlapping joints, either a saddle splined joint or a dovetail joint by providing a connection to a post. Such construction provides an aesthetically pleasing finished product and reflects the traditional values of the environment in which such houses are typically built. Such houses are formed from logs that are rough hewn to shape as they are built into a wall and the gap between the logs sealed with "chinking". As an alternative to the hand hewn log homes, machined logs have been utilized in the construction. Machined logs have a uniform cross section and the abutting faces of the logs are machined to form a seal system to inhibit the ingress of air between the logs making up the wall. Such construction offers greater thermal efficiency for the building and assists in meeting the air infiltration standards of the relevant building codes.

A further aspect of the building code is the minimum thermal rating, commonly referred to as the R value in North America or U-value in Europe, which is the reciprocal of the R value of the wall. U=5.682/R, taking into account the change in units. The R value for a log is accepted to be R 1.25 per inch and to meet a requirement for a minimum insulation value of R16 it would be necessary to provide 12 inch thick logs. Logs of this dimension are expensive and difficult to obtain in volume and as such make it difficult to attain the minimum values required. It is of course possible to increase the thermal efficiency by insulating the internal surface of the wall but this detracts from the inherent aesthetic value of the log wall construction.

A number of attempts have been made to increase the thermal rating of the log wall material by implementing a thermal break in the log. One of those is shown in PCT application WO 96/07802 in which a plurality of longitudinal slots are cut into the body of the log so as to attempt to provide the necessary thermal efficiency. Thin foam strips can then be set into those cuts. However such an arrangement destroys the integrity of the log and requires careful manufacture in order to ensure that the natural movement of the wood does not result in degradation of the log itself. Such an arrangement also makes it difficult for the inter-engaging seal profiles to be manufactured and maintained. Similar deficiencies exist with the arrangements shown in U.S. Pat. Nos. 4,344,263 and 3,992,838.

It has also been proposed to laminate a log construction to obtain a thermal break by using inner and outer log panels with a plastic foam block between as shown in WO/95/30807. Such a process, however, is very expensive to produce and has the risk of de-lamination between the foam and the exterior panels given the lifecycle of such a building. De-lamination would subject the foam core to crushing due to the weight of the balance of the logs and as such is not an acceptable practice.

U.S. patent application Ser. No. 12/491,561 shows a log having a plurality of pockets formed at spaced locations along the log. The pockets are separated by lands constituted by the material of the log that extend transversely between oppositely directed faces of the log. The pockets are filled with an insulating material, typically a foam.

This arrangement enables the required thermal ratings to be obtained whilst maintaining the structural integrity of the log. In some building codes, however, there is a need to provide a continuous thermal break in the body of the wall, which is not met by the provision of the discreet pockets.

It is therefore an object of the present invention to obviate or mitigate the above disadvantages.

According therefore to the present invention there is provided a log having a plurality of pockets formed at spaced locations along the longitudinal axis of the log. The pockets are separated by lands constituted by the material of the log that extend transversely between oppositely directed faces of the log.

Adjacent pockets are interconnected by a longitudinally extending slot intersecting each of the pockets.

The slots provide a discontinuity in each of the lands to provide a thermal break along the longitudinal axis.

Preferably, the slots are offset from the longitudinal axis, and, as a further preference, the slots alternate to opposite sides of the longitudinal axis.

It is also preferred that the cross section of the pocket is such that its dimension along the longitudinal axis varies across the width of the log.

It is also preferred that the slot intersects the pocket at a location to provide a re-entrant surface at the intersection between the slot and pocket.

By providing discreet pockets along the length of the log, the structural integrity of the log is maintained whilst its thermal rating is increased. Sealing profiles may be machined on each of the sealing faces and the terminal portions of the log may be devoid of pockets to permit normal joint construction for the corners. The slot intersecting the pockets establishes a thermal break, and, in the preferred embodiment, the re-entrant surface provides a mechanical collection between the insulating material and the log that inhibits separation.

BRIEF DESCRIPTION OF THE DRAWINGS

Embodiments of the invention will now be describing by way of example only with reference to the accompanying drawings in which.

DETAILED DESCRIPTION OF THE INVENTION

Referring therefore to the drawings, a house 10 has side walls 12, 14 that support a roof 16. The side walls 12, 14 intersect at a corner 18.

Figure 1:
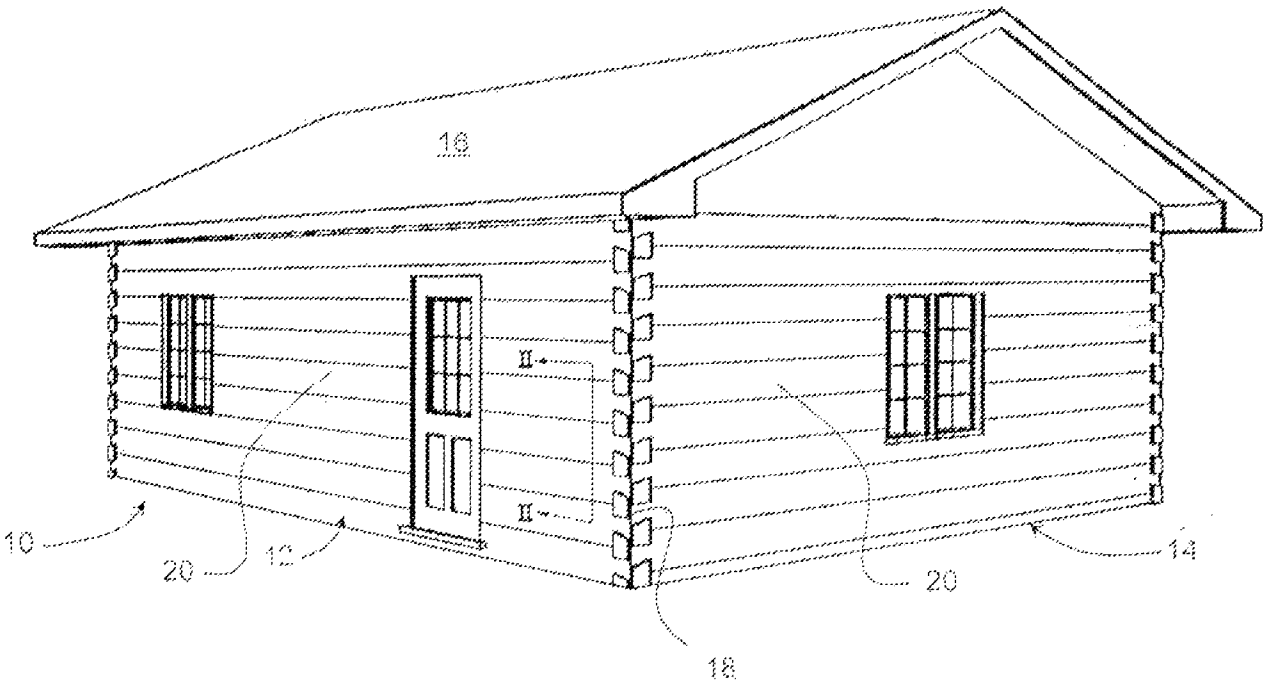
FIG. 1 is a schematic representation of a house having walls formed from logs.
Figure 2:
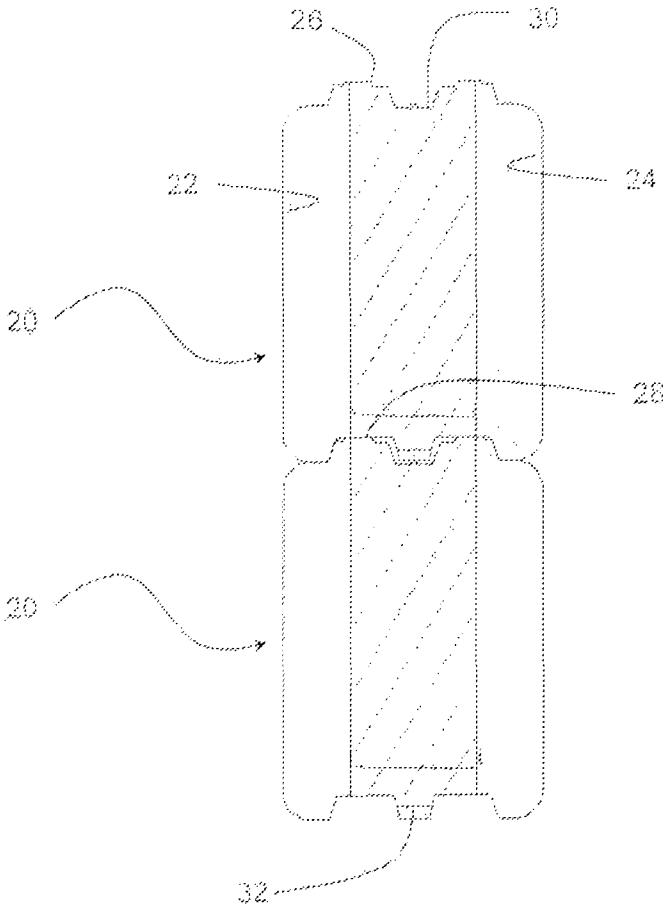
FIG. 2 is a view on the line of II-II of FIG. 1.

Each of the walls 12, 14 is formed from a plurality of logs 20 that extend horizontally and are stacked one above another in a vertical direction. As can be seen in FIG. 2, the logs 20 have a pair of oppositely directed surfaces, designated an outer surface 22 and an inner surface 24. The outer surface 22 and inner surface 24 are interconnected by an upwardly directed surface 26 and a downwardly directed surface 28, it being understood that the terms upper and lower refers to the normal orientation of the logs 20 when assembled into a wall 12,14. The upper and lower surfaces 26, 28 are milled to have complimentary profiles 30,32 such that when stacked one above the other, the profile 32 of lower surface 28 is snugly received on the profile 30 of the upper surface 26. Seals may be incorporated between the tongue and groove formations to provide an effective seal during the inevitable movement of the logs, as more fully described in co-pending Canadian application number 2,557,364.

Figure 3:
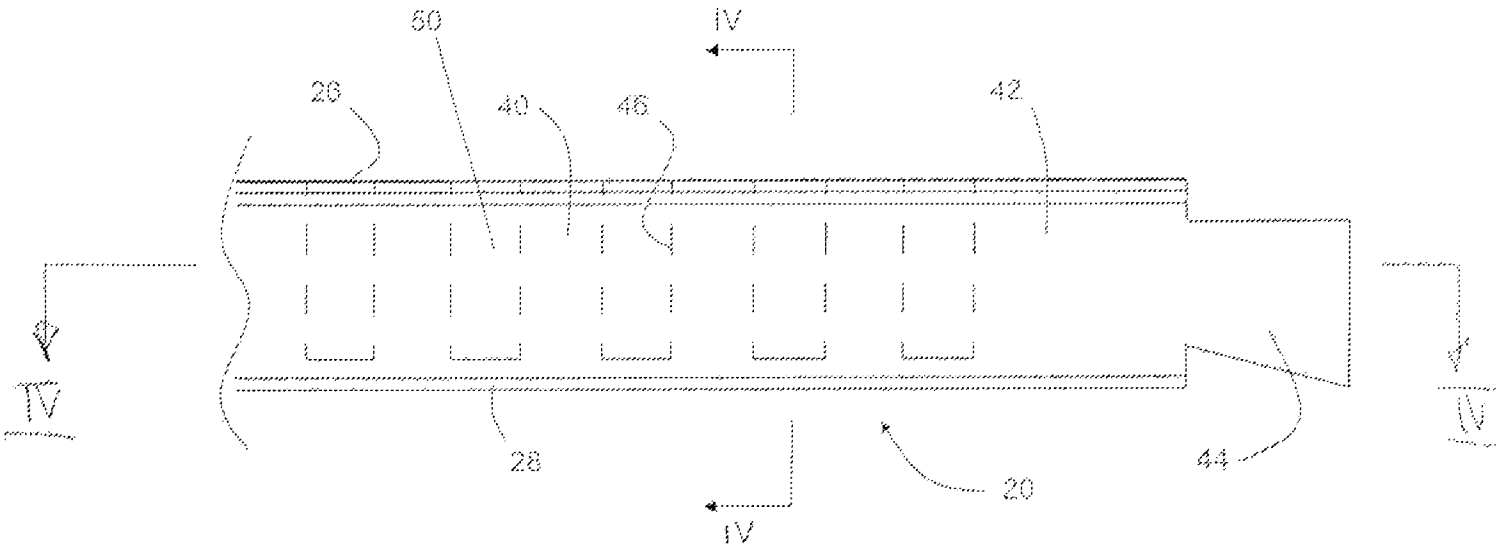
FIG. 3 is a side view of a log used in the wall of the house of FIG. 1.

The log 20 is shown in greater detail in FIGS. 3 to 6 from which it will be seen that it has an elongate body portion 40 with a terminal portion 42. The terminal portion 42 is provided to accommodate a joint that cooperates with a log 20 of an adjacent wall at the corner 18 to interlock the two walls 12,14. As shown in FIG. 3, the terminal portion 42 is provided with a tail 44 that forms one-half of a dovetail joint. It will be appreciated that other constructions may be utilized, such as a saddle joint.

Figure 4:
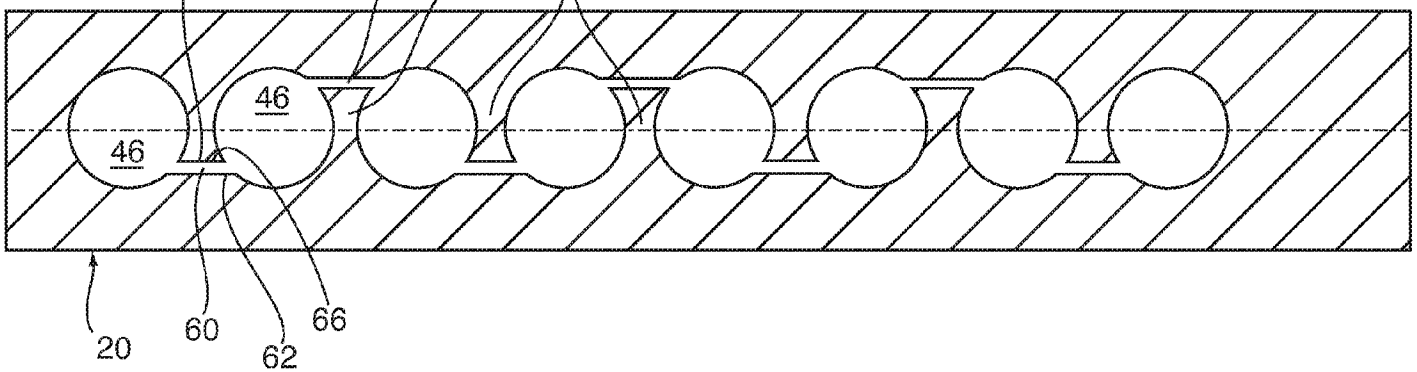
FIG. 4 is a section on the line IV-IV of FIG. 3.
Figure 5:
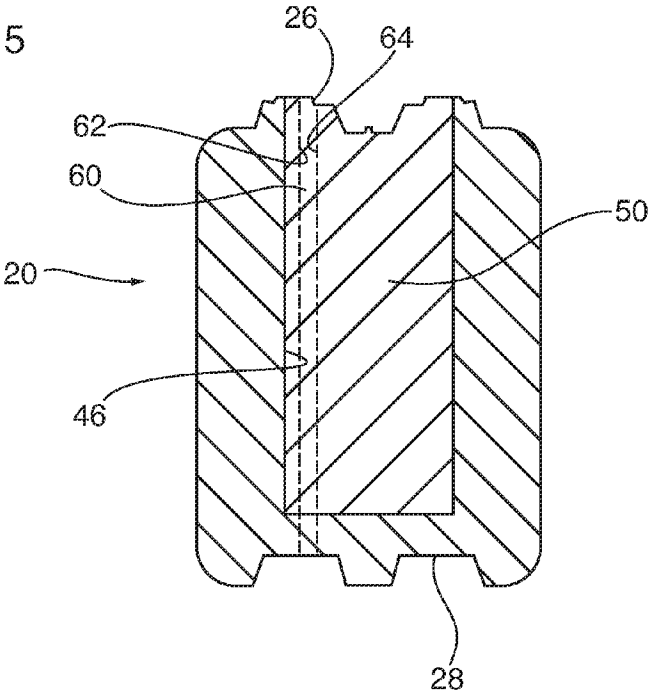
FIG. 5 is a section on the line V-V of FIG. 3.

The body portion 40 is formed with a plurality of pockets each defined by bores 46 that extend from the upper surface 26 toward the lower surface 28. In the embodiment of FIG. 3, the bore 46 is of constant circular cross section and is formed by drilling from the upper surface 26 toward the lower surface 28. The bores 46 are uniformly distributed along the body 40 and have a diameter less than the spacing between the inner and outer walls 22, 24. In a typical embodiment as shown in FIG. 4, a log with a nominal spacing of eight inches between the outer face 22 and inner face 24 is provided with bores having a diameter of four inches. The bores 46 are spaced apart on seven inch centres providing a three inch land 48 between each of the bores 46. With the bores 46 spaced apart on the centre line of the log 20, a nominal two inch boundary layer 49 is provided between the bore 46 and the surfaces 22, 24 respectively. As shown in FIGS. 2 and 5, the bore 46 terminates prior to the lower wall 28 and provides a minimum thickness in the order of 1 inch. Alternatively, the bore 46 may extend between the upper and lower surfaces if preferred. As can be seen from FIG. 4 a slot 60 is defined by a pair of walls, 62, 64, and extends between adjacent bores 46. The walls 62, 64 extend from the upper surface to the lower surface and the slot 60 provides a discontinuity in the land 48. The slot 60 has a transverse dimension of nominally 1 inch, although other widths may be used if preferred.

As shown in FIG. 4, the slot 60 is offset from the centre line of the log 20 so that the walls 62, 64 intersect the bores 46 at a location offset from the diameter of the bore 46. The bore 46 is circular and accordingly, the dimension along the longitudinal axis varies across the width of the log. The intersection of one of the walls 62, 64, with the bore 46, therefore provides a re-entrant surface 66 where the tangent of the wall of the bore 46, and the one of walls 62, 64 subtend an included angle of less than 90°.

Adjacent slots 60 alternate to opposite sides of the longitudinal axis and are typically equally offset from the diameter of the bores 46. The lands 48 thus provide a series of interdigitated waisted tongues that alternate from opposite sides of the log 20 and project beyond the centerline of the log to terminate at the slot 60.

The bores 46 and slots 60 are filled with a expanded foam plug 50 that extends up to the upper surface 26 and is formed to have the same profile as the upper surface 26, as will be described below. The foam plug 50 is typically a closed cell foam such as urethane having a high thermal insulation value. Typically such foams have an insulation of R6 per inch and a suitable foam is available from Polyurethane Foam Systems Inc. of Waterloo, Ontario under the trade name Polarfoam PF-6352-0.

The foam plug 50 may be formed in situ using the bore 46 and slot 60 as a mould. In this case, the lower face of the bore 46 provides a closed vessel to permit pouring of the liquid foam.

The offsetting of the slot 60 from the diameter of the bore 46 enables the foam plug 50 to form a mechanical lock between opposite sides of the log 20. The re-entrant surface 66 provides an abutment that inhibits separation of the foam from the bores 46. The alternating waisted tongues engage with the foam plugs 50 so that compression or shear of the foam is necessary to accommodate lateral movement.

With the configuration of pockets shown in FIG. 4, the insulation value of the log is increased from 1.03 per inch, that is R10.4 to a average value of 20.6. This increased thermal rating is achieved without affecting the structural integrity or the ability of the log to provide an efficient sealing system in the wall. A thermal break is provided along the log 20 by the successive slots 60 whilst maintaining the integrity. The end portions 42 are maintained to permit the corner joints to be formed out of solid material with the body 40 offering a higher thermal efficiency. The provision of the end face of the bore 46 provides sufficient transverse strength to inhibit splitting of the log 20 when the profiles 30,32 are engaged.

The provision of the bores 46 and slots is also beneficial to the production of the logs. By pre-drilling the logs 20 with the bores 46 they may be stored upside down to prevent water collecting in the bores 46. The provision of the bores 46 decreases the drying time of the log significantly from the typical twelve months, allowing the inventory of log to be reduced. Moreover the whole structure also has the effect of stress relieving the log and thereby reducing the surface cracking that is typically present on the surfaces 22, 24. Such surface cracking does not reduce the overall strength of the log but it is aesthetically displeasing. The cracking that does occur will take place on the upper surface 26 between the pockets, thereby enhancing the thermal efficiency of the lands without adversely affecting the structural strength.

The logs 20 as shown in the embodiments of FIGS. 1 through 5 may be produced by initially machining the log blank and drilling the bores 46. The slots 60 are cut using a chain mortiser. The log is then left to dry until the required moisture content is attained, after which the foam plug 50 is formed in each of the bores 46. The plug material is mixed in a liquid form and placed into bores 46 where it forms in situ. Thereafter the upper and lower surfaces 26, 28 are machined to the requisite profile and the tails 44 machined to provide the required joint. The foam plug 50 is supported on all sides by the walls of the bore 46 and therefore milling of the upper face 26 can be accomplished with the foam core in situ. With the upper and lower surfaces 26, 28 formed, the log can then be assembled into a wall having the requisite thermal rating. If preferred, the slots 60 may be cut after that log has dried, just prior to insertion of the foam 50. The stability of the log during drying is thus enhanced, and the slots cut shortly before the foam is inserted and is available to support the opposite sides of the log.

It will be appreciated that the extent of the body 40 may vary from log to log to accommodate features of the building 10 such as doorways and windows. It that event, the end portions 42 may be left solid to accommodate joints or other fixtures, but logs extending across such openings can have the foam plugs 50.

The configuration of the bores 46 and slots may vary according to different requirements. The spacing and size of the pockets is selected to provide an average R value for the log, when the pockets are filled with foam, that is not less than R 16.

Figure 6:
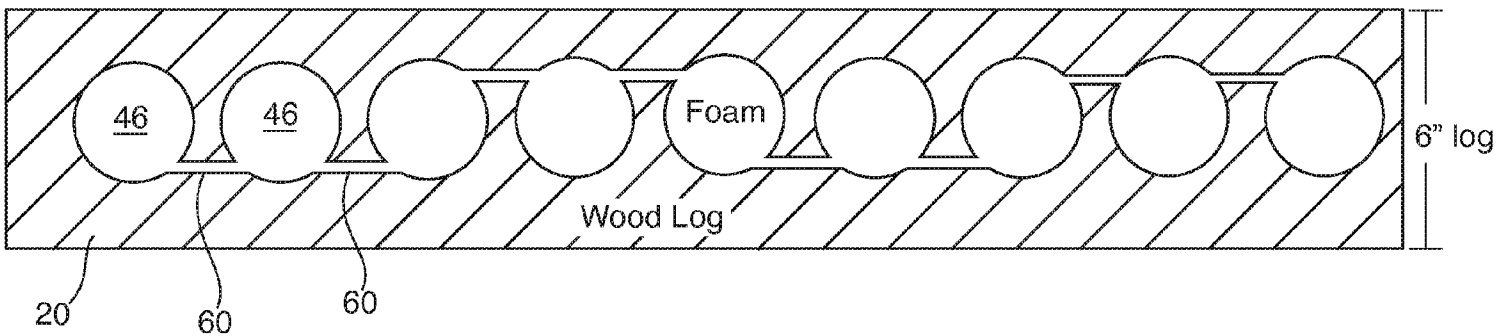
FIG. 6 is a plan view of an alternative embodiment of log.

As shown in FIG. 6, the slots need not alternate between each pair of bores 46, but can extend between two pairs of holes, or move if required.

Figure 7:
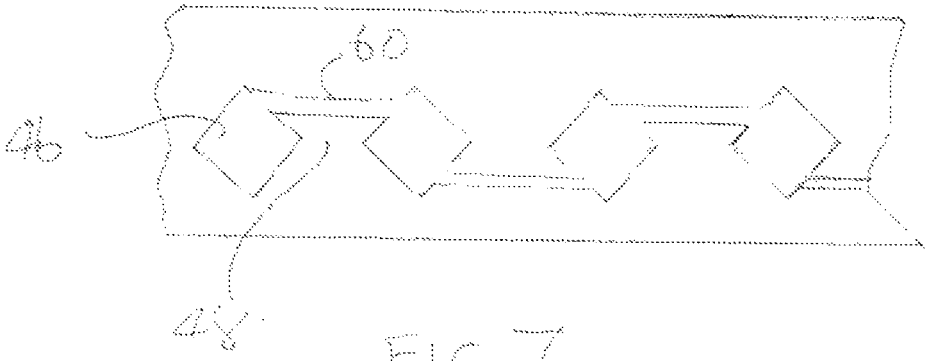
FIG. 7 is a plan view of an alternative embodiment of log.

The bores 46 may also be formed with cross sections other than circular. As shown in FIG. 7, the bores 46 may be square with diagonals aligned with the longitudinal axis. The slots 60 intersect adjacent the apex to define the re-entrant surface and inhibit separation.

Figure 8:
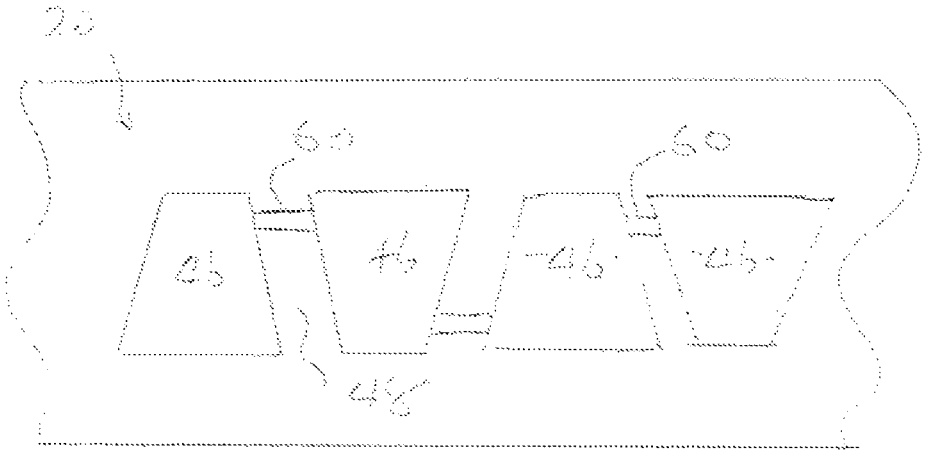
FIG. 8 is a view similar to FIG. 7 showing a further embodiment of log.
Figure 9:
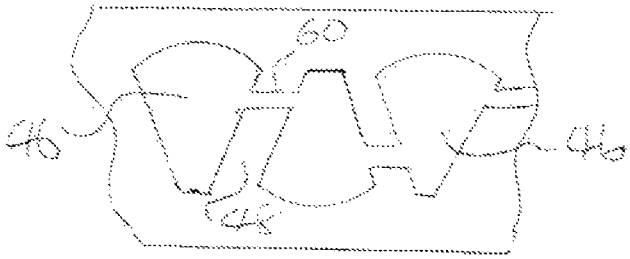
FIG. 9 is a view similar to FIG. 8 showing a further embodiment of log.

Similarly, alternating trapezoidal bores 46 may be formed as shown in FIG. 8, or alternating crescent cross sections, as shown in FIG. 9. The slots 60 are offset, although it will be appreciated that in the arrangements of FIGS. 8 and 9, the slots 60 may be aligned whilst retaining a re-entrant surface 66.

In each of the above embodiments, the bore 46 is of uniform cross section and terminates prior to the lower surface 28. The bores may of course extend through the log, provided provision is made for inserting the foam. Similarly, the slot 60 may terminate prior to the lower surface 28 to enhance the integrity of the log 20.

Figure 10:
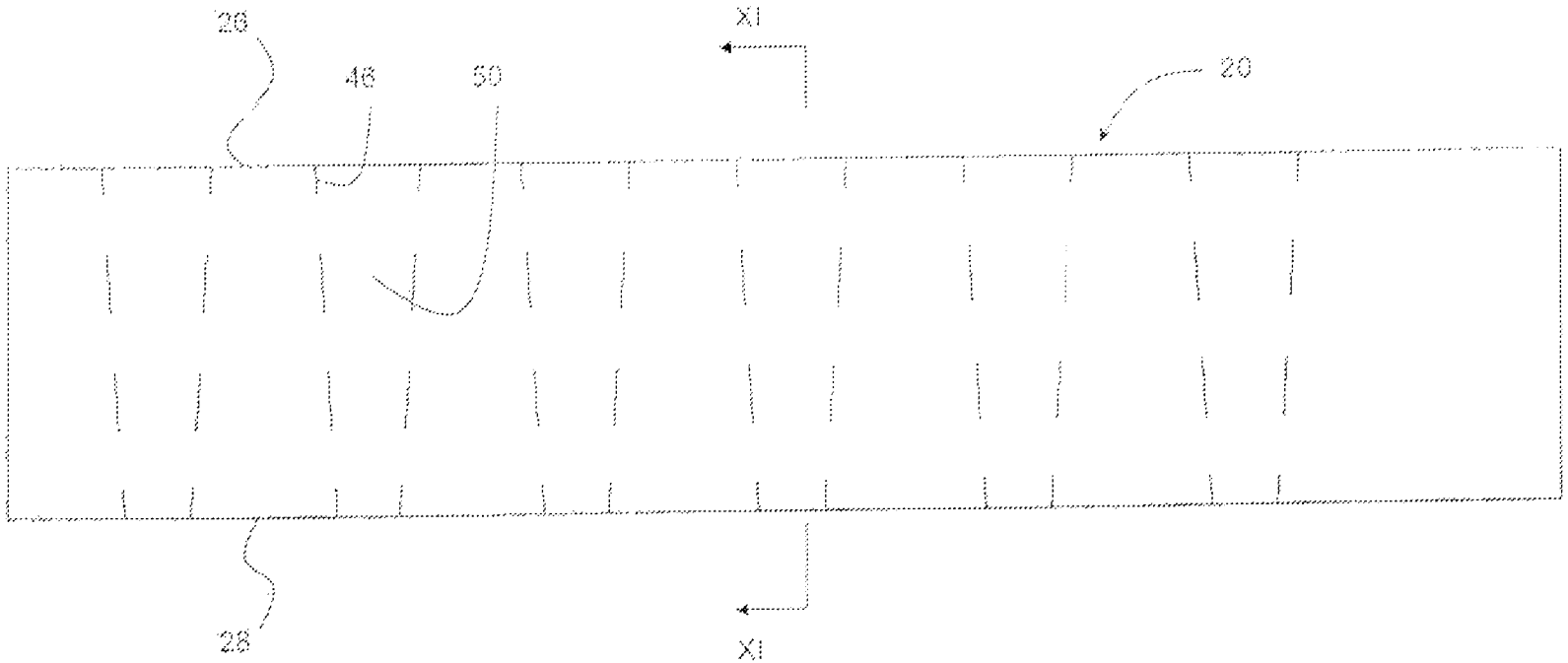
FIG. 10 is a side view similar to FIG. 3 showing an alternative configuration of log.
Figure 11:
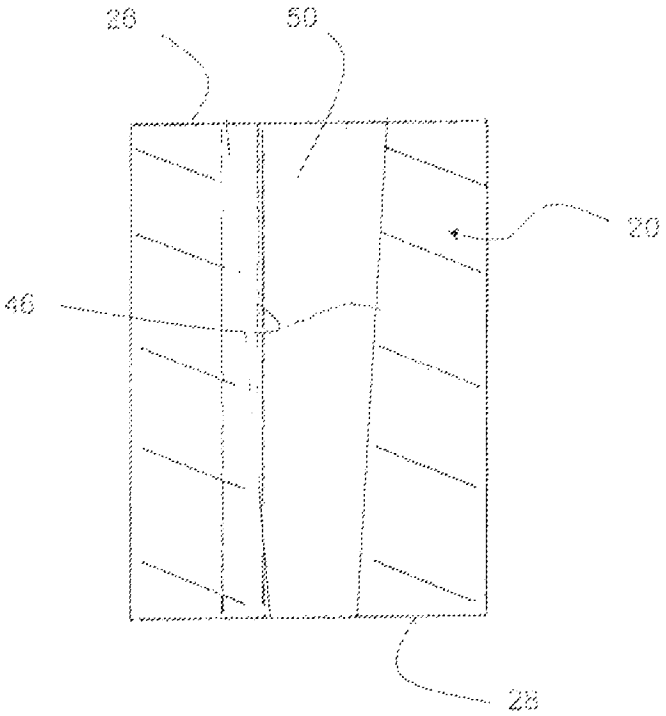
FIG. 11 is a section on the line XI-XI of FIG. 10.

It will also be appreciated that the cross sectional area of the bore may be increased by inclining the axis of the bore. In the embodiment shown in FIGS. 10 and 11, the bore 46 is formed with a tapered cross section and extends between the opposite faces of the log 20. Slots 60 are offset from the longitudinal axis and intersect the bores 46. The tapered cross section permits pre-formed plugs 50 that are also tapered to be inserted into the bores 56 where a tight fit is ensured by virtue of the taper. The slots 60 may be foamed in situ or sheets may be inserted if preferred. This arrangement permits the advantages of the increased thermal rating to be obtained without requiring onsite storage of foaming materials and related material handling concerns. With the arrangement shown in FIGS. 10 and 11, the plug may be inserted, secured within the bore 46 and the upper and lower surfaces machined to provide the finished log 20.

It will be seen therefore that the provision of the pockets in the log 20 provides a opportunity to increase the thermal rating without adversely affecting the integrity of the log. The lands between each of the bores provides sufficient strength to avoid crushing of the log. The provision of the foam also allows the sealed profiles to be machined in the plug together with the balance of the sealing faces and for the log to maintain the integrity of the end portions for conventional joining techniques. The slots provide a thermal break, and, in the preferred embodiment, are arranged to inhibit separation of the log along the longitudinal axis.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A log having an elongate body with a pair of oppositely directed wall faces extending between a pair of oppositely directed sealing faces, a plurality of pockets extending from one of said sealing faces into said body and uniformly spaced along said body, said pockets being separated from one another by lands extending between said wail faces, adjacent pairs of said pockets being interconnected by a slot intersecting said one of said sealing faces and extending inwardly into said body and through a land separating said adjacent pair of pockets to provide a discontinuity in said land and thereby provide a thermal break.

2. A log according to claim wherein said slot is offset from the longitudinal axis of said log.

3. A log according to claim 2 wherein the slots in adjacent lands alternate to opposite sides of said longitudinal axis.

4. The log according to 1 wherein each of said pockets has a cross section that varies in dimension measured along the longitudinal axis across the width of the log.

5. The log according to claim 4 wherein said slot is offset laterally from the location of the maximum dimension of said pocket.

6. The log according to claim 4 wherein the slot intersects the pocket at a location to provide a re-entrant surface at the intersection between the slot and pocket.

7. The log according to claim 1 wherein terminal portions of said body are devoid of pockets.

8. The log according to claim 1 wherein said sealing face has sealing formations formed thereon for engagement with a complimentary formation on an adjacent log.

9. The log according to claim 1 wherein said pockets extend between said sealing faces.

10. The log according to claim 1 wherein said pockets are of substantially constant cross section.

11. The log according to claim 1 wherein said pockets taper.

12. The log according to claim 1 wherein said pockets are distributed and sized to provide an increase in thermal rating of said log to at least R16.

13. The log according to claim 1 wherein said pockets are filled with foam.

14. The log according to claim 1 wherein the said pockets are circular.

15. The log according to claim 14 wherein said slot is offset laterally from the diameter of said pocket.

16. The log according to claim 1 wherein said pockets are square and a diagonal is aligned with a longitudinal axis of said log.

17. The log according to claim 16 wherein said slot is offset laterally from said diagonal.

18. The log according to claim 1 wherein said pockets are wedge shaped.

19. The log according to claim 18 wherein said pockets alternate along said longitudinal axis to provide parallel sides of said pockets and said slot that extends between adjacent pockets is offset from said longitudinal axis.

* * * * *